US005582382A

United States Patent [19]

Pan-Yang

[11] Patent Number: 5,582,382

[45] Date of Patent: Dec. 10, 1996

[54] FOLDING BOOK STAND

[76] Inventor: Pi-Ju Pan-Yang, No. 576, Chung-Yang Rd., Feng-Yuan City, Taichung Hsien, Taiwan

[21] Appl. No.: 497,056

[22] Filed: Jun. 30, 1995

[51] Int. Cl.[6] ..... A47B 97/00

[52] U.S. Cl. ..... 248/456; 248/461; 248/465

[58] Field of Search ..... 248/461, 465, 248/454, 441.1, 456

[56] References Cited

U.S. PATENT DOCUMENTS

| | | | |
|---|---|---|---|
| 543,812 | 7/1895 | Platt | 248/461 X |
| 1,203,659 | 11/1916 | Smith | 248/456 |
| 1,564,594 | 12/1925 | Leh | 248/456 X |
| 2,224,530 | 12/1940 | Weinstein | 248/456 X |
| 2,792,668 | 5/1957 | Gallamos | 248/456 |
| 3,562,796 | 2/1971 | Jacobson | 248/456 |
| 4,323,214 | 4/1982 | DeLuca | 248/461 X |
| 4,467,727 | 8/1984 | Strommer | 248/456 X |

*Primary Examiner*—Karen J. Chotkowski
*Attorney, Agent, or Firm*—Bacon & Thomas

[57] ABSTRACT

A folding book stand including a base plate having a pivot at the front side, a back plate pivotably connected to the pivot by a first connecting arm and supported in any of a series of tilted positions by a back stand, and a book holder pivotably connected to the pivot by a second connecting arm ad supported in a tilted position perpendicular to the first connecting arm, wherein the base plate defines a flat bottom chamber for receiving the back plate, the back stand and the book holder when the book stand is folded up.

3 Claims, 6 Drawing Sheets

FOLDING BOOK STAND

BACKGROUND OF THE INVENTION

The present invention relates to book stand, and relates more particularly to a folding book stand which can be folded up into a flat condition when not in use and, which can be adjusted to hold the book in any of a series of tilted positions.

When writing or arranging data, one may prepare reference books for reference. If to lie a reference book on the table and opened for reading, the reference book will occupy much table space. Furthermore, when reading a reference book, a reader may have to hold down the leaves of the reference book by the hand or a paper weight. However, one tends to be annoyed and impatient when reading a reference book in such a manner. There are book stands developed to eliminate these problems. FIG. 1 shows a folding book stand which can be arranged in the operative position to support a book in a tilted position convenient for reading, or folded up into a collapsed condition when not in use. This folding book stand is comprised of a base plate, a supporting plate, and two folding arms bilaterally connected between the base plate and the supporting plate. The supporting plate has a flange perpendicularly disposed at one end for supporting the book. This structure of book stand is suitable for supporting a thin book or few sheets of paper only. When a book is opened and supported on this structure of book stand, the leaves of the book tend to be turned by wind. Furthermore, this structure of book stand does not cause a sense of beauty.

SUMMARY OF THE INVENTION

It is one object of the present invention to provide a book stand which can be folded up into a flat condition when not in use. It is another object of the present invention to provide a book stand which can be conveniently adjusted to hold the book in the desired tilted position. It is still another object of the present invention to provide a book stand which can keep the book opened and prevent the leaves of the book from being turned by wind.

DETAILED DESCRIPTION OF THE PREFERRED EMBODIMENT

Figure 1A:
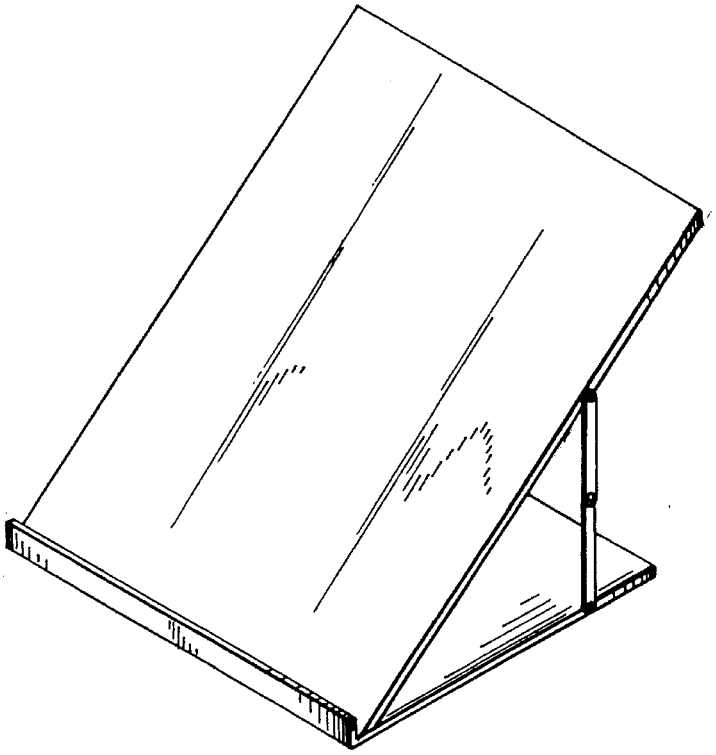
Fig. 1A PRIOR ART
FIG. 1A is an elevational view of a prior art folding book stand set in the operation position.
Figure 1B:
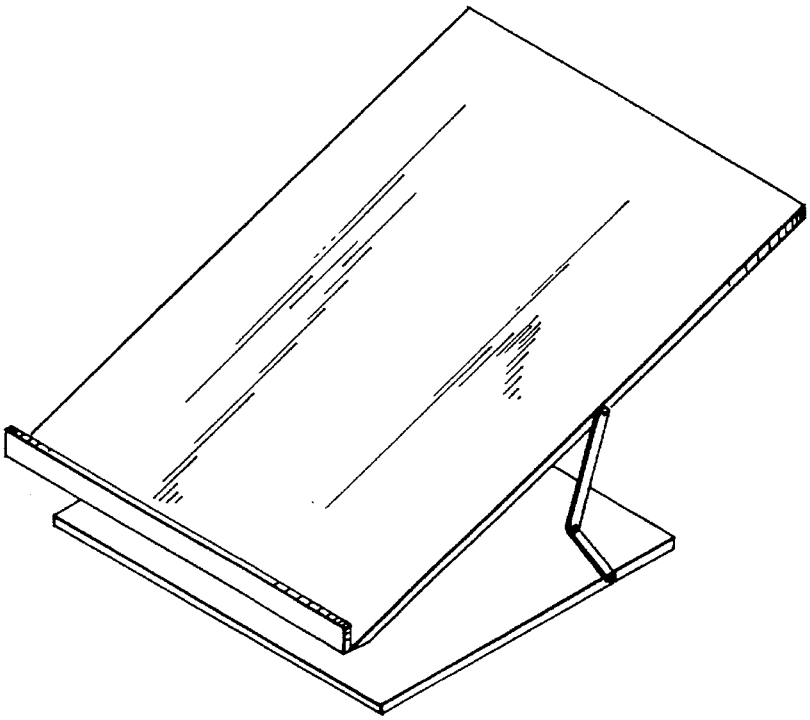
Fig. 1B PRIOR ART
FIG. 1B shows the folding book stand of FIG. 1A folded up.
Figure 2:
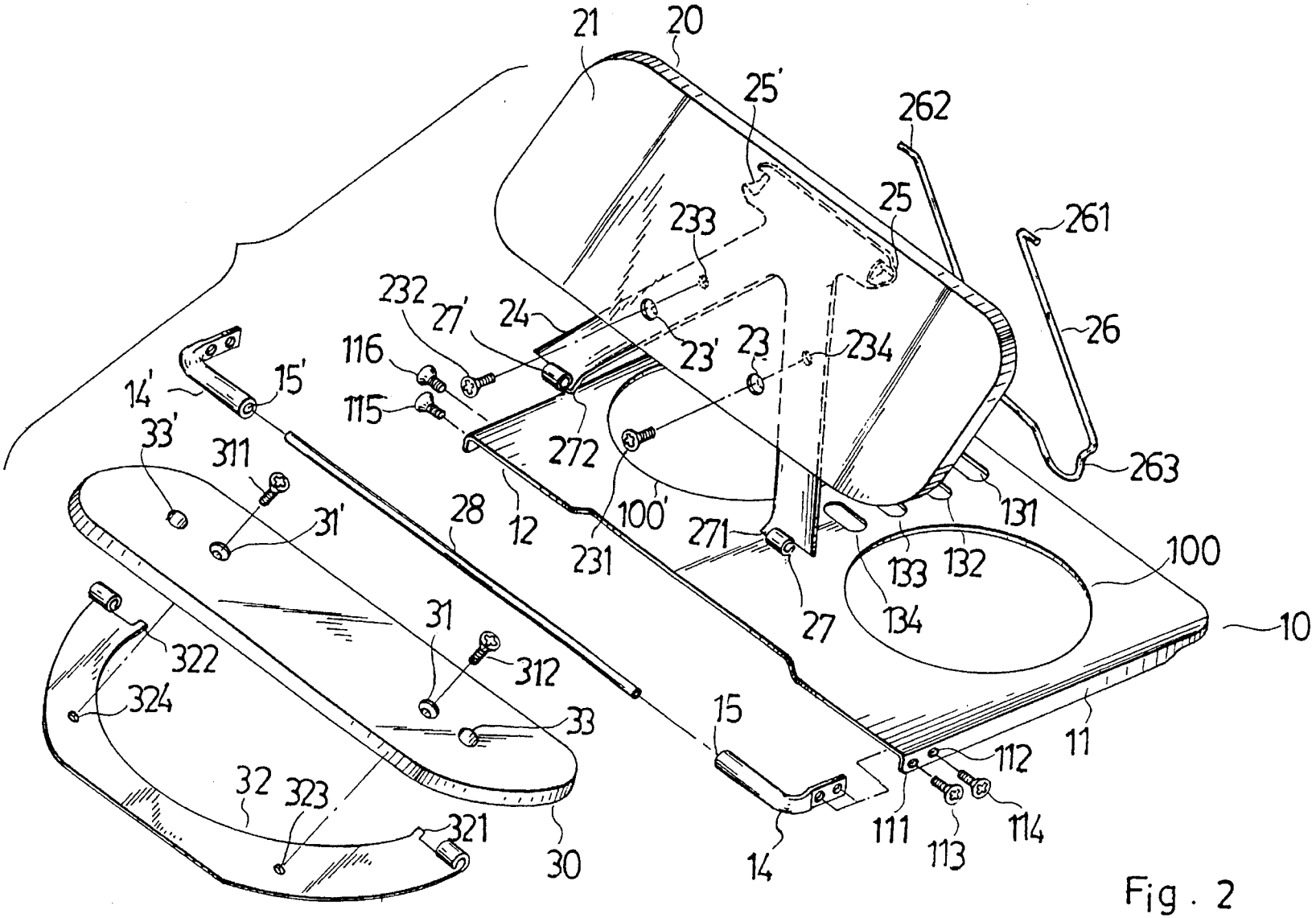
FIG. 2 is an exploded view of a folding book stand according to the present invention.
Figure 3:
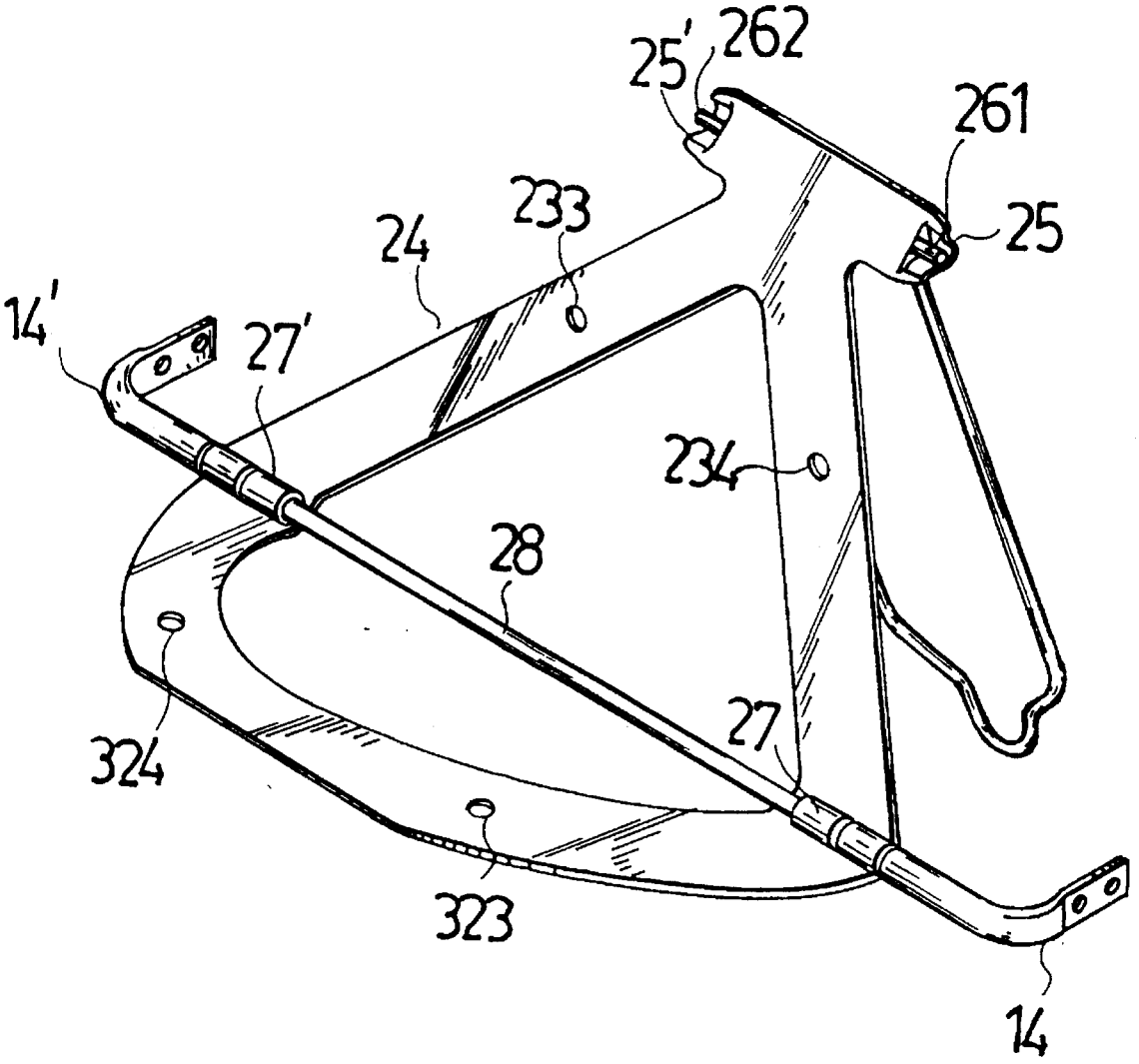
FIG. 3 shows the first connecting arm and the second connecting arm respectively connected to the pivot, and the back stand connected to the first connecting arm according to the present invention.

Referring to FIGS. 2 and 3, a folding book stand in accordance with the present invention is generally comprised of a flat rectangular base plate 10, a back plate 20, and a book holder 30. The base plate 10 comprises a downward flange 11 around two short sides (the two opposite lateral sides) and one long side (the back side), a flat bottom chamber 12 defined within the downward flange 11, a series of locating holes 131,132, 133 and 134 transversely spaced in the middle, two opposite pairs of mounting holes 111 and 112 on the downward flange 11 adjacent to the front side, and two circular decorative openings 100 and 100'. Two angle rods 14 are respectively and fixedly fastened to the mounting holes 111 and 112 on the downward flange 11 of the base plate 10 by screws 113, 114, 115 and 116 to hold a pivot 28 in front of the front side of bottom chamber 12. The pivot 28 has two opposite ends respectively inserted into a respective axial hole 15 on each angle rod 14. The back plate 20 has a front supporting side 21, a back coupling side 22 (see also FIG. 5), and two countersunk holes 23 and 23' through the front supporting side 21 and the back coupling side 22. A substantially V-shaped connecting arm 24 is invertedly connected between the back plate 20 and the pivot 28. The V-shaped connecting arm 24 is attached to the back coupling side 22 of the back plate 20, having two through holes 233 and 234 respectively fastened to the countersunk holes 23' and 23 by screws 232 and 231, two axle housings 25 and 25' spaced at one end and closely attached to the back coupling side 22 of the back plate 20 for coupling a back stand 26, two barrels 27 and 27' spaced at an opposite end and respectively sleeved onto the pivot 28, and two stop projections 271 and 272 respectively extended from the barrels 27 and 27 and facing each other. A back stand 26 is provided for supporting the back plate 20 in a tilted position, having two coupling tips 261 and 262 turned outwards at one end in reversed directions and respectively inserted into the axle housings 25 and 25' on the V-shaped connecting arm 24, and a plug portion 263 at an opposite end for insertion into one locating hole 131, 132, 133 or 134 on the base plate 10. The book holder 30 is a flat rectangular board connected to the pivot 28 by a connecting arm 32. The width of the book holder 30 is approximately equal to the distance between the pivot 28 and the back plate 20 so that the book holder 30 and the back plate 20 can be arranged on the same plane when the book stand is collapsed. The hook holder 30 has two countersunk holes 31 and 31' respectively connected to respective through holes 323 and 324 on the connecting arm 32 by screws 312 and 311, and two recessed pen holes 33 and 33' for holding a respective pen. The connecting arm 32 is made of substantially arched shape and turned about the pivot 28, having two stop projections 321 and 322 corresponding to the stop projections 271 and 272 on the connecting arm 24, and two through holes 323 and 324 respectively connected to the countersunk holes 31 and 31' on the book holder 30 by screws 312 and 311.

Figure 5:
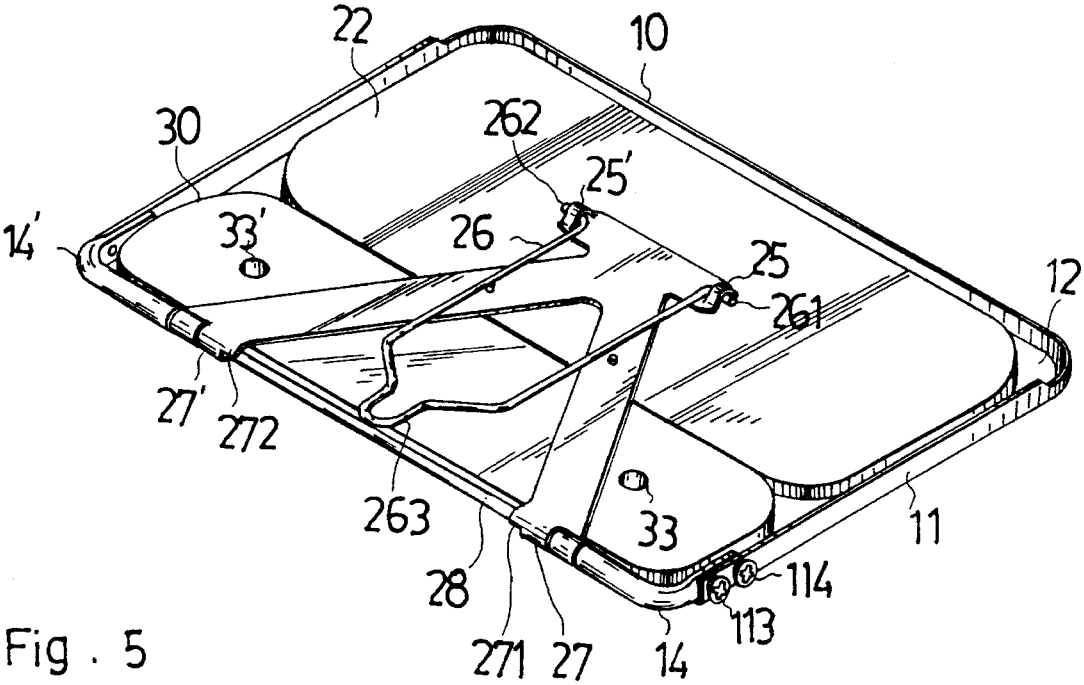
FIG. 5 shows the folding book stand of FIG. 4 folded up.

Referring to FIG. 5, by turning the connecting arms 24 and 32 about the pivot 28 toward the bottom side of the base plate 10, the back plate 20 and the book holder 30 can be received within the flat bottom chamber 12 inside the base plate 10 with the back stand 26 lain on the V-shaped connecting arm 24.

Figure 4:
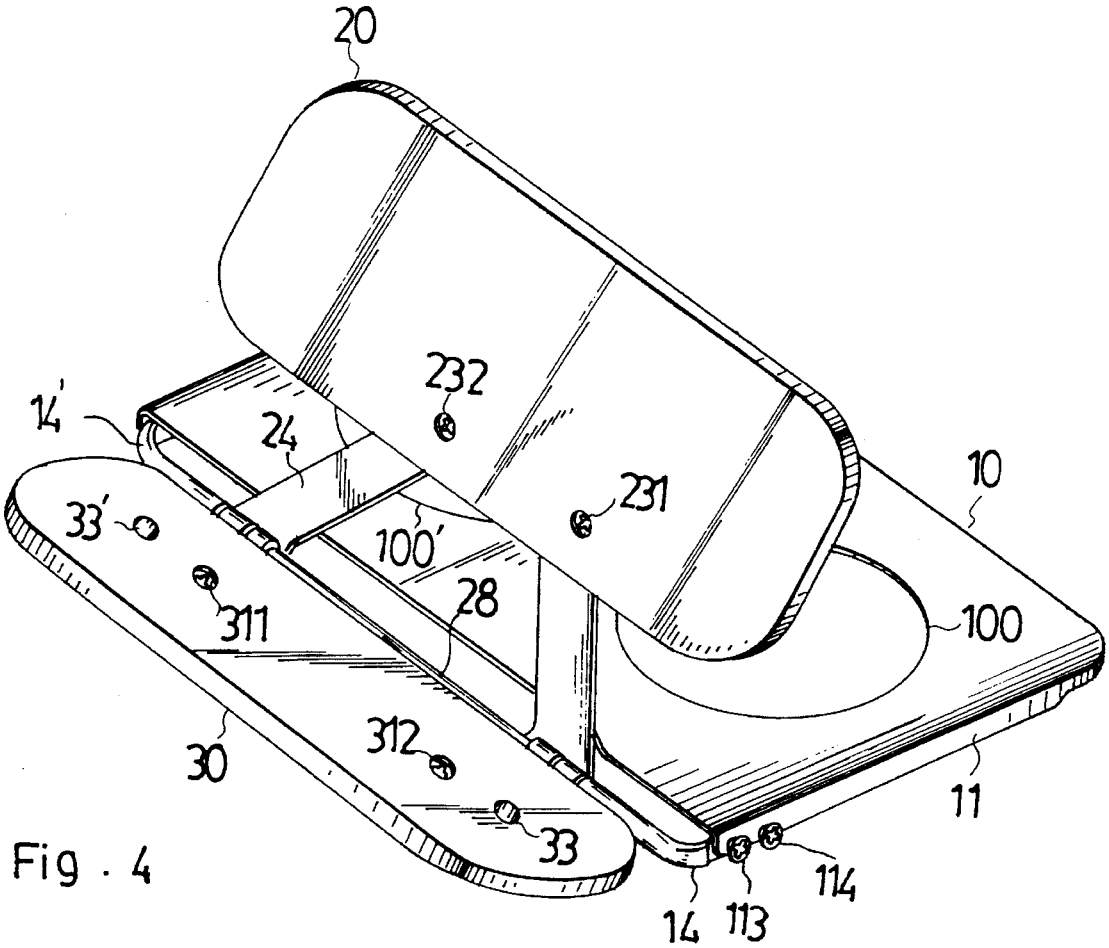
FIG. 4 shows the folding book stand of FIG. 2 set in the operative position.

Referring to FIG. 4, when in use, the connecting arms 24 and 32 are turned about the pivot 28 to move the back plate 20 and the book holder 30 out of the bottom chamber 12 of the base plate 10, then the back plate 20 is supported by the back stand 26 in a tilted position by inserting the plug portion 263 of the back stand 26 into one locating hole 131, 132, 133 or 134. When the back plate 20 is supported by the back stand 26 in a tilted position, the stop projections 321 and 322 of the connecting arm 32 are respectively stopped by the stop projections 271 and 272 of the connecting arm 24, causing the book holder 30 retained in a sloping position perpendicular to the V-shaped connecting arm 24.

Figure 6A:
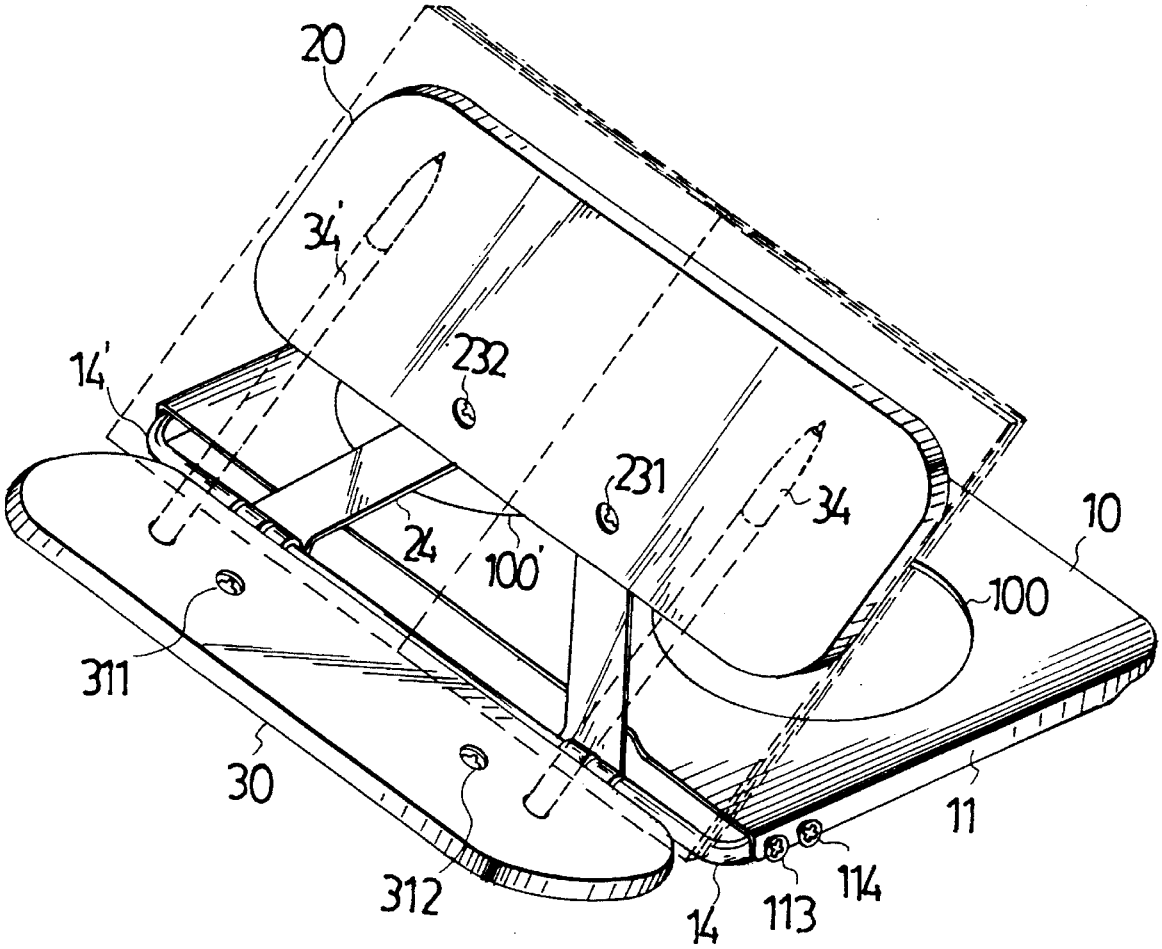
FIG. 6A is an applied view of the present invention showing a book supported on the book holder and the back plate held down by two pens.

Referring to FIG. 6A, when a book is placed on the book holder 30 and supported on the back plate 20 and opened, two pens 34 and 34' can be inserted into the recessed pen holes 312 and 311 on the book holder 30 to hold down the leaves of the book.

Figure 6B:
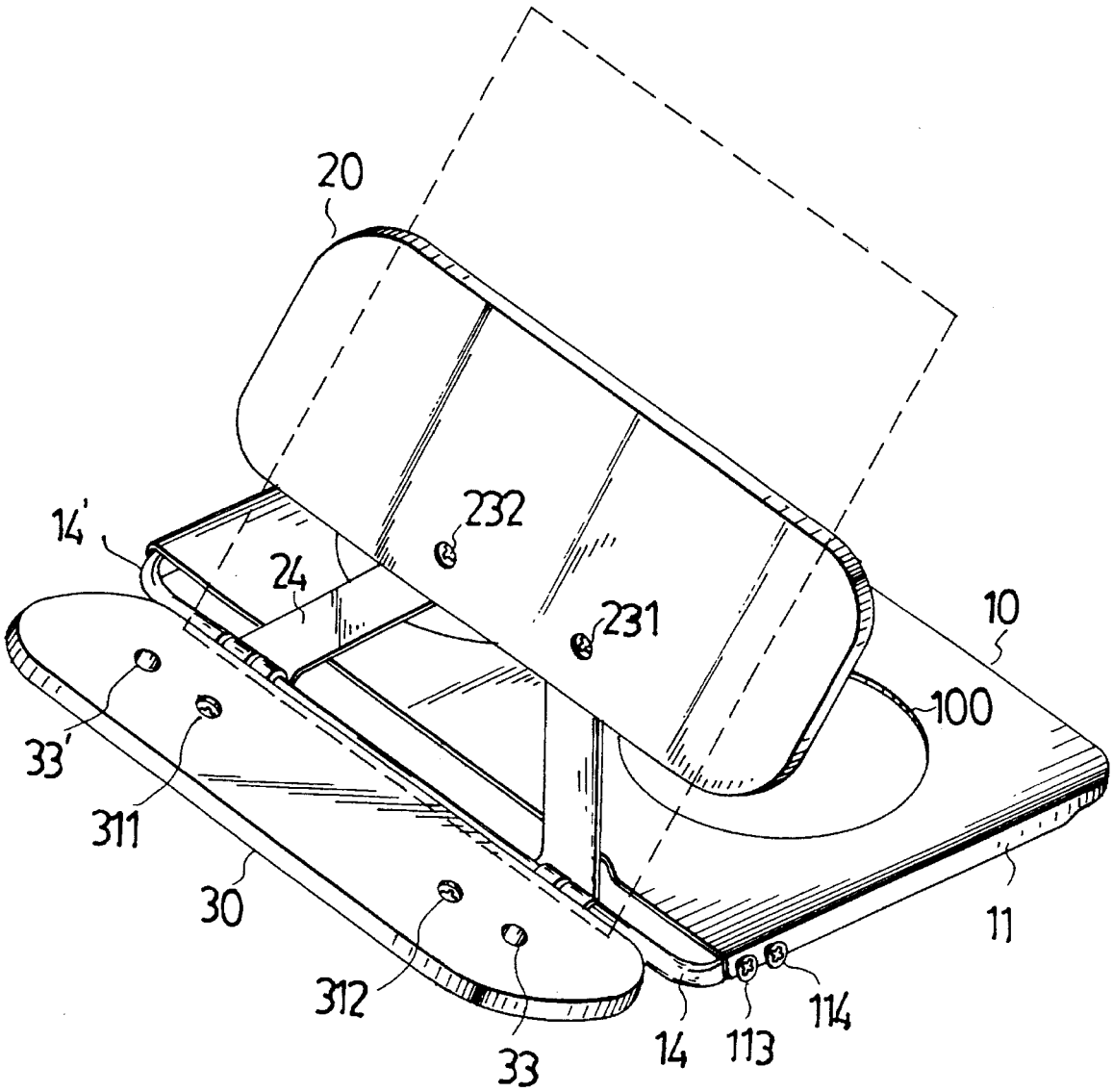
FIG. 6B is another applied view of the present invention showing a sheet of paper supported on the book holder and the back plate.

Referring to FIG. 6B, the book stand can also be used as a copy holder to hold sheets of paper.

I claim:

1. A book stand comprising:

a flat base plate having a series of locating holes transversely spaced in the middle, two angle rods bilaterally disposed at a front side, and a pivot connected between said angle rods;

a back plate;

a first connecting arm turned about said pivot and connected between said pivot and said back plate, said first connecting arm having one end fixedly secured to said back plate at a back side thereof and terminating in two opposite axle housings, and an opposite end terminating in two barrels and two stop projections, said barrels being sleeved onto said pivot for permitting said first connecting arm with said back plate to be turned about said pivot;

a back stand having two coupling tips turned outwards at one end in reversed directions and revolvably inserted into said axle housings on said first connecting arm, and a plug portion at an opposite end for insertion into one locating hole on said base plate;

a flat rectangular book holder pivotably connected to said pivot and stopped by the stop projections of said first connecting arm in a tilted position perpendicular to said first connecting arm, said book holder having two recessed pen holes for holding a respective pen; and a second connecting arm fixedly secured to said book holder and turned about said pivot, having two stop projections for stopping against the stop projections on said first connecting arm to hold said book holder in a tilted position perpendicular to said first connecting arm.

2. The book stand of claim 1 wherein said base plate has a downward flange around the border defining a flat bottom chamber for receiving said back plate and said book holder when collapsed.

3. The book stand of claim 1 wherein said second connecting arm is made of arched shape.

* * * * *